US007721900B2

(12) United States Patent
Waterman

(10) Patent No.: US 7,721,900 B2
(45) Date of Patent: May 25, 2010

(54) SPORTBOARD STORAGE RACK SYSTEM

(76) Inventor: James R. Waterman, 10 Kendall Dr., Westborough, MA (US) 01581

( * ) Notice: Subject to any disclaimer, the term of this patent is extended or adjusted under 35 U.S.C. 154(b) by 628 days.

(21) Appl. No.: 11/295,235

(22) Filed: Dec. 6, 2005

(65) Prior Publication Data

US 2007/0125731 A1 Jun. 7, 2007

(51) Int. Cl.
*A47G 7/00* (2006.01)

(52) U.S. Cl. ..... 211/70.5; 211/85.7; 211/89.01

(58) Field of Classification Search ..... 211/85.7, 211/60.1, 70.5, 66, 85.29, 70.6, 89.01, 87.01; 206/806, 483, 477; 248/345.1
See application file for complete search history.

(56) References Cited

U.S. PATENT DOCUMENTS 944,312 A * 12/1909 Brede ..... 211/70.6
2,371,433 A * 3/1945 Davis ..... 211/70.6
2,581,824 A * 1/1952 Windahl ..... 280/815
3,394,790 A * 7/1968 Braun ..... 194/256
3,504,405 A * 4/1970 Elliott-Smith ..... 70/58
3,537,595 A * 11/1970 Mathisen ..... 211/89.01
3,756,420 A * 9/1973 Brown ..... 211/70.5
4,049,126 A * 9/1977 Halverson ..... 211/60.1
4,241,836 A * 12/1980 Cousins ..... 211/14
4,583,647 A * 4/1986 Schinzing ..... 211/60.1
4,763,797 A * 8/1988 Egan ..... 211/70.5
4,871,074 A * 10/1989 Bryson et al. ..... 211/26
4,936,602 A * 6/1990 Adkins ..... 280/809
5,305,897 A * 4/1994 Smith ..... 211/85.7
5,316,155 A * 5/1994 Collins et al. ..... 211/70.5
5,678,700 A * 10/1997 Crosson, Jr. ..... 211/60.1
5,806,691 A * 9/1998 Nelson ..... 211/70.5
6,196,397 B1 * 3/2001 Maher ..... 211/85.7
6,305,557 B1 * 10/2001 Brooks ..... 211/70.6
6,564,949 B1 * 5/2003 Saathoff ..... 211/70.6
6,712,226 B1 * 3/2004 Williams, Jr. ..... 211/85.7
6,719,153 B2 * 4/2004 Heneveld ..... 211/70.6
6,827,226 B2 * 12/2004 Coulson ..... 211/85.7
2004/0099624 A1 * 5/2004 Hein ..... 211/89.01
2005/0269276 A1 * 12/2005 Pfeiffer ..... 211/70.6
2006/0118499 A1 * 6/2006 Kao ..... 211/70.6
2007/0080124 A1 * 4/2007 Frentzel ..... 211/74

* cited by examiner

*Primary Examiner*—Michael Safavi
(74) *Attorney, Agent, or Firm*—Brian M. Dingman; Mirick, O'Connell, DeMallie & Lougee, LLP

(57) ABSTRACT

A sportboard storage rack system, for holding one or more sportboards that have a narrow region and a wider region. The rack system has a first member that defines a blind recess into which a sportboard is placed, the recess having an open face with a width that is greater than the width of the narrow region of the sportboard and less than the width of the wider region of the sportboard, the recess also having an inner area in communication with the open face, the inner area having a width that is greater than the width of the open face, and less than the width of the wider region of the sportboard.

8 Claims, 4 Drawing Sheets

SPORTBOARD STORAGE RACK SYSTEM

FIELD OF THE INVENTION

This invention relates to a storage rack system for sportboards such as snowboards, skis, surfboards, skateboards and the like.

BACKGROUND OF THE INVENTION

Sportboards such as snowboards, skis, wakeboards, surfboards, skateboards, mountainboards and the like have gained in popularity. These boards are typically tapered in the middle or at the ends. Many of these boards, such as snowboards and skis, have a more narrow, central "waist" region, and wider end regions. Surfboards, on the other hand, typically have a wider central region and more narrow end regions.

In order to maintain such boards in optimal condition, it is necessary to store the boards in a manner that prevents them from getting nicked or crushed. Many times, this equipment is stored in a basement or garage, along with other items. There is thus a danger of these boards being damaged in storage. Also, these boards can be quite large and thus take up substantial floor space.

These same concerns apply to the retail display of sportboards. There is thus the need for a sportboard storage rack system that solves the problems associated with typical current homeowner and retailer sportboard storage.

One proposed solution for sportboard storage is described in U.S. Pat. No. 6,827,226. That patent discloses an apparatus with gripping members that are movable relative to a base member, to support sportboards of different widths. The gripping members are angled such that they match the angle of the flared edges of the sportboard. The gripping members grip along a portion of the edges and along a portion of the thickness of the sportboard.

Although this apparatus may be satisfactory for storage of sportboards, it is rather complex to use, expensive to make, and prone to failure. For example, since the gripping members are held to the base with a screw, the gripping members can potentially be insufficiently tightened or come loose, which can result in the board falling from the apparatus. Further, as the gripping members grip only a portion of the thickness of the board, if they are not properly placed tightly against the two edges of the board, the board can slip out of the apparatus. The multi-part apparatus is both expensive to manufacture and relatively difficult to install. Further, as the gripping members can be removed from the base, the gripping members can be lost.

SUMMARY OF THE INVENTION

It is therefore an object of this invention to provide a sportboard storage rack system that is easy to use, manufacture and install.

It is a further object of this invention to provide such a sportboard storage rack system which overlays the front of the board so that the board cannot fall from the rack.

It is a further object of this invention to provide such a sportboard storage rack system that supports the sportboards at two spaced locations so that the sportboards cannot contact the wall on which they are mounted.

It is a further object of this invention to provide such a sportboard storage rack system which displays sportboards in a manner in which their front sides are visible, so that a customer can see any graphics on the board.

This invention features a sportboard storage rack system, for holding one or more sportboards that have a narrow region and a wider region, the rack system comprising a first member that defines a blind recess into which a sportboard is placed, the recess having an open face with a width that is greater than the width of the narrow region of the sportboard and less than the width of the wider region of the sportboard, the recess also having an inner area in communication with the open face, the inner area having a width that is greater than the width of the open face and less than the width of the wider region of the sportboard.

The sportboard storage rack system may further comprise a second member, spaced from the first member, for supporting a sportboard placed into the first member. The first and second members are preferably each integral. The first member preferably defines a series of spaced blind recesses. At least two of the blind recesses may have dimensions that differ from one another, so that the rack system can accommodate sportboards having different widths.

In several specific embodiments designed to hold snowboards, a recess may have an open face width of at least about 9.25 inches and an inner area width of at least about 9.75 inches; or an open face width of at least about 9.75 inches and an inner area width of at least about 10.25 inches; or an open face width of at least about 10.5 inches and an inner area width of at least about 11 inches. The open faces of the two adjacent recesses may be spaced from one another by at least about 3.5 inches.

The second member may be spaced about 30 inches from the first member. Both members may be elongated and have about the same length. The second member may have a thickness that is about the same as the thickness of the first member, not including the recess. The first member may be mounted to a generally vertical surface, with the open face of the blind recess facing away from the vertical surface. The blind recess may be bordered by interior walls that taper towards one another, in which case the taper may be arranged such that the walls are closer together at their lower ends than they are at their upper ends. The walls may be curved towards one another. Both members may be made from wood or plastic.

The sportboard may have a thickness at opposite sides, and the blind recess may have a depth that is greater than that thickness, so that the portions of the member adjacent the open face of a recess overlie the sides of the sportboard when the sportboard is placed in the recess. One or more of the recesses may be defined at least in part by a movable portion. The movable portion may be slidable relative to the first member. The movable portion and the first member may be interlocked in a dovetail-type joint.

BRIEF DESCRIPTION OF THE DRAWINGS

Other objects, features and advantages will occur to those skilled in the art from the following description of the preferred embodiments, and the accompanying drawings, in which like numbers are used for like parts, wherein.

DETAILED DESCRIPTION OF THE PREFERRED EMBODIMENTS OF THE INVENTION

This invention may be accomplished in a sportboard storage rack system that has two separate members, each of which is a single, unitary (integral) piece. A first member has one or more openings or recesses bounded by engaging arms that extend across a portion of the opening. The second member is a flat strip. The sportboard is placed into an opening in the first member, and moved down until opposite edges of the board engage opposite edges of the recess, with the engaging arms overlaying the front of the board so that it cannot fall from the first member. The second member is mounted at an appropriate distance from the first member such that the other end of the sportboard rests against the second member.

The inventive sportboard storage rack system thus allows the storage of one or multiple sportboards on a wall, in both home and commercial applications. The rack system provides an effective method for storing and displaying boards, and one that minimizes the potential for damage that might otherwise occur if the boards were stored improperly on the ground or leaning against the wall. The rack system also protects the board's natural arched shape, which can be compromised if such boards are stored flat. It also allows storage of boards with bindings, such as snowboards and skis, in a manner in which none of the bindings touch each other and any board can be removed from the rack system without the need to remove any other board. The rack system also stores the sportboards in a manner in which the entire graphic design on the upper surface of the board is visible, thereby creating an excellent display tool for retailers.

Figure 1:
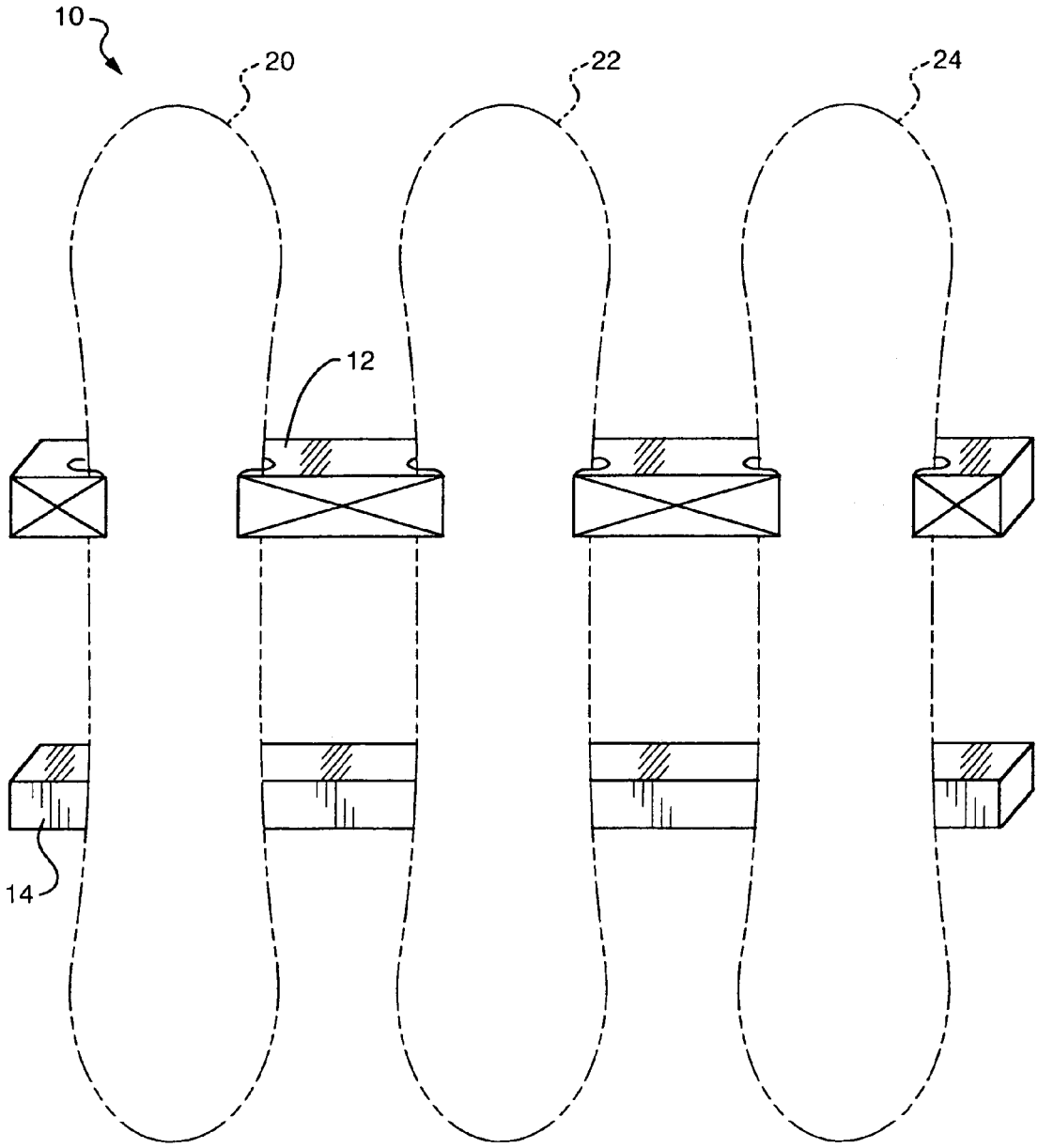
FIG. 1 is a front view of a preferred sportboard storage rack system of the invention, shown holding three sportboards.
Figure 2:
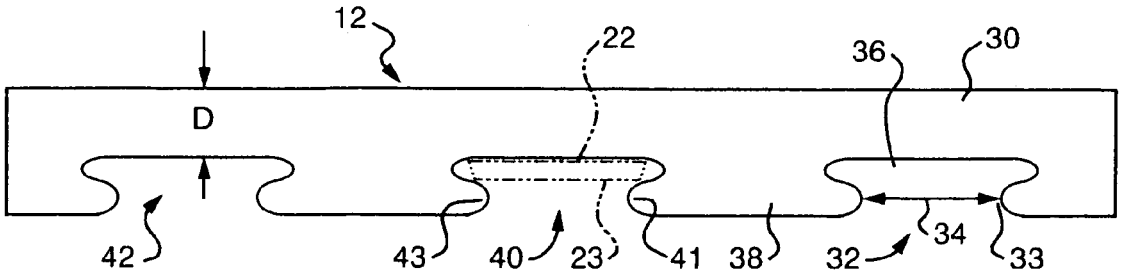
FIG. 2 is a top plan view of the first member of the sportboard storage rack system of FIG. 1.
Figure 3:
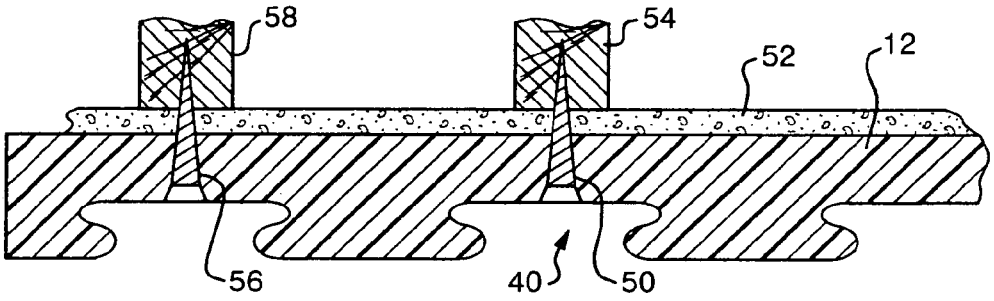
FIG. 3 is a view similar to that of FIG. 2, but detailing the preferred installation method.

One preferred embodiment of sportboard storage rack system 10 according to this invention is shown in FIGS. 1 through 3. Sportboard storage rack system 10 includes first member 12 and second member 14. First member 12 is configured to grip one or more sportboards. The member is designed to be mounted on a wall or other generally vertical surface. Rack system 10 thus stores sportboards up off the floor and securely, so that they are unlikely to be damaged in storage. Optional second member 14 is mounted at an appropriate distance from member 12 so that the sportboard rests against member 14. This prevents the other end of the sportboard from contacting the wall. FIG. 1 depicts rack system 10 designed to hold three snowboards, 20, 22 and 24. The sizes, shapes, dimensions and quantities of sportboard-retaining openings are all options of the invention. The particular features and preferred dimensions of rack system 10 are described below.

FIG. 2 is a top view of member 12. Member 12 in this case defines three spaced blind recesses, 32, 40 and 42, as explained below. The recesses can be sized and located to accept different types of sportboards and/or different sized sportboards. Only one sportboard 22 is shown (in phantom) engaged in recess 40, for the sake of clarity. If the recesses are made deeper than shown, they can also hold multiple sportboards, for example a pair of skis.

Recess 32 illustrates the details of construction of the recesses. Recess 32 has open face 33 with a width 34 that is greater than the width of the narrow region of the sportboard, and less than the width of the wider region of the sportboard. This is shown in more detail in FIG. 4 described below. Recess 32 also has inner area 36 that is wider than open face 33. This construction defines a pair of what are termed "engaging arms" that overlie the face of the board. Such are illustrated relative to recess 40, in which engaging arms 41 and 43 overlie the front 23 of the board 22 so that board 22 is securely held in member 12.

Member 12 is preferably an integral or unitary member, and can be made of wood or plastic. Each of these materials has the requisite strength and also will not rust. The rack will thus not promote rusting of any metal edges of the sportboard. The rack system of the invention is adapted to be mounted to a wall or other generally vertical surface. Most building construction is accomplished with structural members located on 16-inch centers. An example is wall studs 54 and 58, FIG. 3. Typically, wallboard or another finished face 52 is mounted to studs 54 and 58. Member 12 is preferably mounted to the wall by including pre-made openings (holes) on 16-inch centers that can accept screws or other fasteners 50 and 56 that can be placed through member 12 and into studs 54 and 58, respectively. FIG. 3 shows these openings at the back of the blind recesses, but that is not a limitation of the invention, as the recesses need not be spaced on 16-inch centers. It so happens, however, that for a rack system designed to hold typically-sized snowboards, the recesses can be conveniently located on 16 inch centers so that the fasteners can be located at the back of the recesses and thus need to only pass through the thickness D, FIG. 2, of member 12.

Preferably, if second member 14 is used, member 14 has a thickness equal to dimension "D", in which case the bottom of the board rests against strip 14, with the board held in a vertical position; this helps to maintain the natural arch to the board. The distance between members 12 and 14 is established such that member 14 prevents the opposite end of the sportboard from contacting the wall. For snowboards, this distance is typically about 30 inches.

Figure 4:
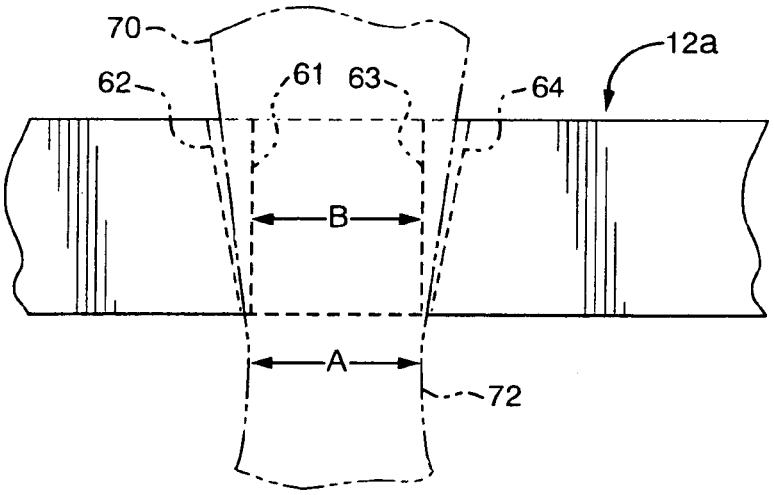
FIG. 4 is a partial, close-up view of a sportboard stored in an alternative embodiment of the sportboard storage rack system of FIG. 1.

FIG. 4 is a partial, schematic, close-up view of a single board 70 seated in a blind recess in first member 12*a*. Member 12*a* is identical to member 12, FIG. 1, except for the particular configuration of the recess. FIG. 4 illustrates a preferred construction of member 10*a* that creates a blind recess with outer opposite side walls 62 and 64 that are tapered toward one another from top to bottom, to generally follow the taper of the edges of board 70 where board 70 engages in the opening. This taper is not a requirement, as the walls can have other configurations and still hold the board in the rack, for example vertical walls as shown in FIG. 2. The open face of the opening, having a width B, is bounded by the inner edges of engaging arms 61 and 63. As illustrated in the drawing, the open face width B is greater than the width A of narrow region 72 of board 70. This allows board 70 to be placed into the opening by aligning the narrowed waist 72 with the opening and pushing the board into the recess. The board is then allowed to slide down until the wider upper section of the board is seated against edges 62 and 64, and behind engaging arms 61 and 63. Board 70 is thus securely held in member 10*a*. Interior walls 62 and 64 can be vertical, or tapered towards one another, or tapered towards one another and slightly curved at the approximate radius of the sportboard that the rack system is designed to hold. The rack system can thus gently support the sportboard with minimal chances of any harm to the body of the board, or the (typically metal) edges of the board that are designed to engage snow or water, for example.

One non-limiting example of the invention is a rack system designed to hold snowboards. Snowboards typically come in three standard sizes. The smallest is a junior board that has an overall length that can average about 52 inches, a maximum width of about 10.5 to 10.75 inches, and a waist width of about 9.125 inches. The thickness is typically about 0.375 inches. A blind recess that will snugly hold such a board will have a depth of about 0.75 inches or more, an open face width of at least about 9.25 inches, and an inner area width of at least about 9.75 inches. Thickness "D", FIG. 2, is also about 0.75 inches. For an adult regular snowboard, the overall length that can average about 58 inches, the maximum width at the top and bottom is about 11.375 inches, the thickness is 0.375 inches, and the waist dimension is about 9.625 inches. In this case, the blind recess has a face with an opening of at least about 9.75 inches and an inner area with a width of at least about 10.25 inches. The depth of the recess and the thickness of the member is the same as that for the junior board. Finally, an adult wide board typically has an overall length that can average about 66 inches, a maximum width of about 12.625 inches, a thickness of about 0.5 inches, and a waist width of about 10.5 inches. These boards are designed to accommodate larger adults, and adults with large feet that require longer bindings. In this case, the thickness of the first member and the depth of the recess can remain the same as in the other two cases. The open face has a minimum width of about 10.5 inches and the inner area has a minimum width of about 11 inches.

For first members that are designed to hold more than one snowboard, the inner edges of adjacent engaging arms for adjacent openings should have a separation of at least 3.5 inches. This is typically a sufficient distance to account for any overhang of the mountings and bindings for adjacent boards, and still allow the boards to be stored in a manner in which a board can be removed from the rack system without disturbing any other board. The second member preferably has a thickness equal to thickness "D", which is commonly 0.75 inches. Combined with the dimensions set forth above, the overall dimensions and length of the rack system can be designed to hold a desired size and quantity of one or more types of snowboards. This same reasoning is applicable to other types of sportboards such as skis, wakeboards, skateboards, and mountain boards, for example, although the particular dimensions would be adjusted as necessary to accommodate one or more types, sizes and shapes of sportboards.

Figure 5B:
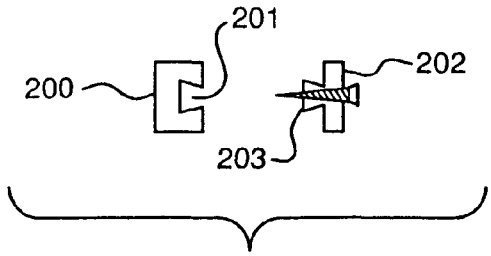
FIG. 5A is a front view and FIG. 5B is an exploded end view, respectively, of an alternative embodiment having one or more movable portions that define one or more of the engaging arms of the first member.
Figure 5A:
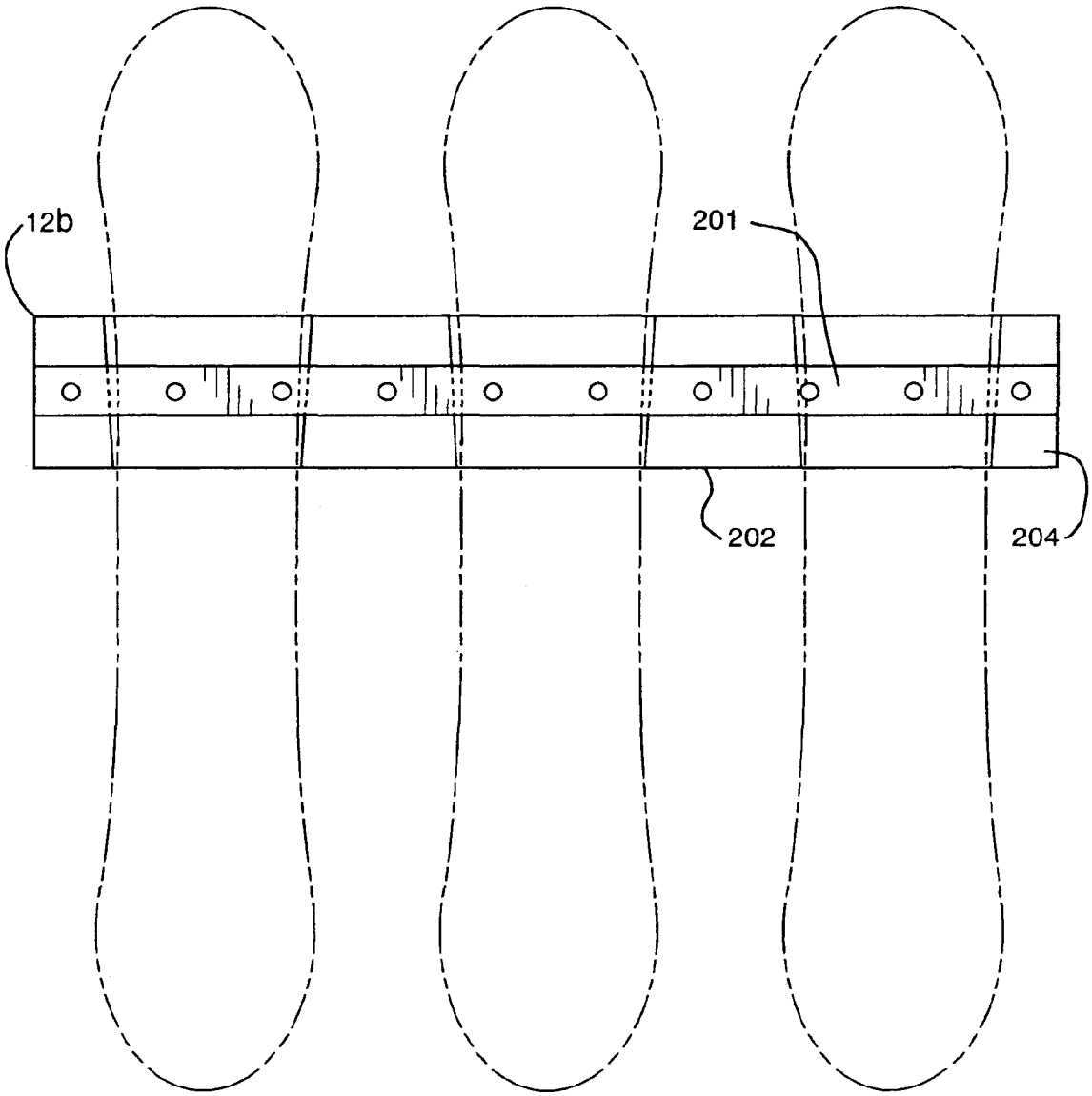

Another alternative embodiment is shown in FIGS. 5A and 5B. First member 12*b* in this case has one or more movable portions such as portion 202 that define one or more of the engaging arms against which the sides of a sportboard are engaged. In this example, member 12*b* has fixed or movable end portion 204, and movable interior portion 202. Any one or more of the portions can be movable. Movable portions allow for periodic adjustments for users who may obtain sportboards of different widths. Portion 202 can have a generally trapezoidal shape so that it can accommodate adjacent edges of two different sportboards.

The one or more movable portions 202 can be movably engaged with base member 200 in any desired fashion. In this non-limiting example, the engagement is accomplished by arranging base member 200 with a dovetail groove 201, and portion 202 with a matching dovetail protrusion 203 that fits into groove 201. This makes the two permanently engaged, but relatively movable. A fastener such as a screw (shown) can be used to fix portion 202 in base 200, by providing in the base a series of pre-formed holes. Various other alternative arrangements can accomplish these aims.

Figure 6A:
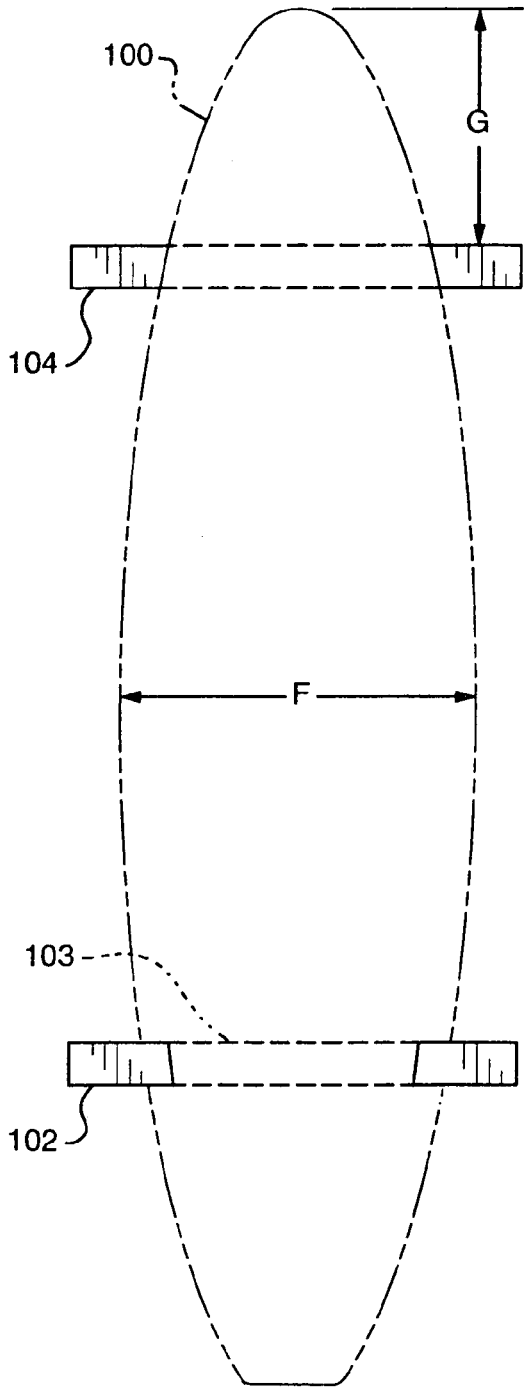
FIGS. 6A and 6B are front and side views, respectively, of an alternative embodiment of the sportboard storage rack system of the invention, which is particularly adapted for storing surfboards and other sportboards with a wide waist and one or two narrowed ends.
Figure 6B:
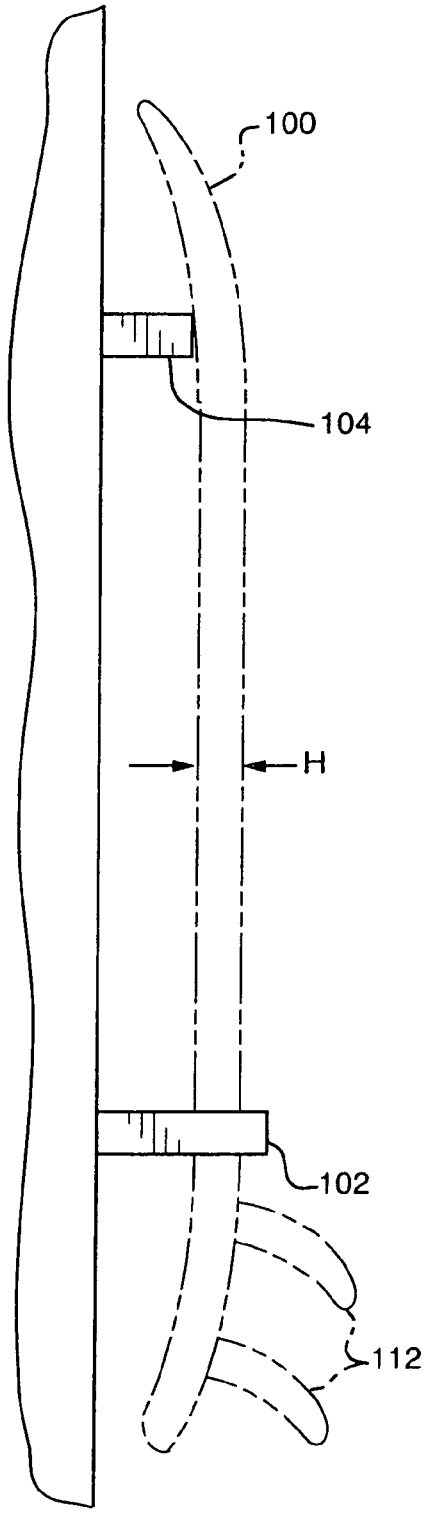

There are other types of sportboards that also have at least one narrowed region and at least one wide region, but do not have a narrowed waist. One primary example is surfboards. Typically, as shown in FIG. 6A, surfboards have a widest region in the middle, with a width F. The board then narrows to create more narrow regions towards both ends. In the case of a board with this general construction, the first member of the inventive rack system is located so that it accepts the bottom end of the board, rather than the narrow waist of the board. FIG. 6A schematically depicts the first member 102 with blind recess 103 into which board 100 has been placed, in the same manner as described above. In this case, however, the back end of the board with fins 112 has been placed into opening 103 and then slid down until the edges of the board engage the inside of the inner area of recess 103. Second member 104 in this case is located above first member 102, and is adapted to hold board 100 in a generally vertical position and also keep the upper end of board 100 from contacting the wall.

If the rack system is made of wood, the one or more blind recesses can be cut into the wood in a desired fashion to achieve a properly-shaped blind recess with rounded edges so as not to damage the board. The rack system can also be made of plastic, through either injection molding or extrusion using a properly shaped die. In embodiments with a second member, the second member is typically a strip of wood or plastic with the proper thickness, which can be cut to about the same length as the first member.

Although specific features of the invention are shown in some drawings and not others, this is for convenience only as the features may be combined in accordance with the invention. Other embodiments will occur to those skilled in the art and are within the following claims.

What is claimed is:

1. A sportboard storage system mounted to a generally vertical surface, the storage system holding in a side-by-side configuration at least three sportboards, each sportboard defining a front end, a back end, an arched shape between the ends, a narrow region with a first width, a wider region with a second width, and a cross section that defines a top bounded by two top edges, a bottom bounded by two bottom edges, and two opposite sides, the sportboard defining a thickness at the opposite sides, the sportboard storage system comprising:

an integral, one-piece elongated horizontal storage member having a front face and a rear face, the two faces having the same height that defines the height of the storage member, the storage member defining an overall thickness between the front and rear faces, the storage member having a length that substantially exceeds its height;

the storage member further defining at least three spaced elongated, blind, vertically-oriented sportboard-receiving recesses, each of the at least three sportboards located in one of the recesses of the storage member;

in which each recess has an open face at the front face of the storage member, the open face having a width that is greater than the first width of the sportboard and less than the second width of the sportboard, each recess also having an inner area in communication with the open face and bounded by an inner wall that defines the recess surface that is closest to the vertical surface to which the storage member is mounted, and shaped sidewalls connecting the inner wall and the open face;

in which the inner area of each recess has a width that is greater than the width of the recess open face, and less than the width of the wider region of the sportboard;

in which each recess has a depth that is greater than the thickness of the sportboard held in the recess at the opposite sides of the sportboard;

in which the storage member at each recess defines a pair of separated engaging arms whose separation defines the open face of the recess, in which each engaging arm defines a rounded distal end located adjacent to the open face of the recess, and in which the rounded distal end engages with one top edge and extends over the top of the sportboard that is located in the recess;

in which each sportboard-receiving recess further defines concavely-curved sidewalls between each engaging arm and the inner wall of the recess;

in which the engaging arms and the concavely-curved sidewalls are arranged such that the storage member contacts the sportboard that is located in the recess at both top edges and the bottom of the sportboard, but does not contact the sides of the sportboard;

in which the engaging arms prevent the sportboard from falling out of the cavity through its open face;

in which the storage member is horizontally mounted to a generally vertical surface, with the open faces of its sportboard-receiving recesses facing away from the generally vertical surface; and a separate integral, elongated, one-piece flat strip that defines a rear face, the flat strip the same length as the storage member and having a thickness that is the same as the thickness of the storage member from the inner wall of each recess in the storage member to its rear face;

in which the flat strip is horizontally mounted to the generally vertical surface with the rear face of the flat strip against the generally vertical surface, the flat strip mounted spaced from and below the storage member a sufficient distance such that one or more of the sportboards held by the storage member rest against the flat strip toward the back end of the sportboard below its arch, to prevent the back end of the sportboard from contacting the generally vertical surface;

in which the storage system prevents any part of the sportboards that are held in the storage member from contacting the generally vertical surface.

2. The sportboard storage system of claim 1, in which a recess has an open face width of at least about 9.25 inches and an inner area width of at least about 9.75 inches.

3. The sportboard storage system of claim 1, in which a recess has an open face width of at least about 9.75 inches and an inner area width of at least about 10.25 inches.

4. The sportboard storage system of claim 1, in which a recess has an open face width of at least about 10.5 inches and an inner area width of at least about 11 inches.

5. The sportboard storage system of claim 1, in which the flat strip is spaced about 30 inches below the storage member.

6. The sportboard storage system of claim 1, in which the curved sidewalls of each recess taper toward one another from the top to the bottom of the recess.

7. The sportboard storage system of claim 1, in which the storage member and the flat strip are made from wood or plastic.

8. The sportboard storage system of claim 1, in which the open faces of any two adjacent recesses are spaced from one another by at least 3.5 inches.

* * * * *